United States Patent [19]

Bearden, Jr. et al.

[11] Patent Number: 4,637,871

[45] Date of Patent: Jan. 20, 1987

[54] HYDROCRACKING WITH AQUEOUS PHOSPHOMOLYBDIC ACID

[75] Inventors: Roby Bearden, Jr.; Clyde L. Aldridge, both of Baton Rouge, La.

[73] Assignee: Exxon Research and Engineering Company, Florham Park, N.J.

[21] Appl. No.: 785,994

[22] Filed: Oct. 10, 1985

Related U.S. Application Data

[63] Continuation-in-part of Ser. No. 728,281, Apr. 29, 1985.

[51] Int. Cl.[4] ..... C10G 47/02

[52] U.S. Cl. ..... 208/112; 208/108; 208/420

[58] Field of Search ..... 502/173, 312; 208/112 L, 420, 108

[56] References Cited

U.S. PATENT DOCUMENTS

| | | | |
|---|---|---|---|
| 3,532,617 | 10/1970 | Hodgson | 208/10 |
| 4,077,867 | 3/1978 | Aldridge et al. | 208/10 |
| 4,111,787 | 9/1978 | Aldridge et al. | 208/10 |
| 4,125,455 | 11/1978 | Herbstman | 208/108 |
| 4,169,101 | 9/1979 | Ucciani et al. | 502/173 |
| 4,196,072 | 4/1980 | Aldridge et al. | 208/112 L |
| 4,226,742 | 10/1980 | Bearden, Jr. et al. | 252/431 |
| 4,244,839 | 1/1981 | Aldridge et al. | 252/431 |
| 4,424,110 | 1/1984 | Bearden, Jr. et al. | 208/112 L |
| 4,557,822 | 12/1985 | Bearden, Jr. et al. | 208/10 |

*Primary Examiner*—John Doll
*Assistant Examiner*—Lance Johnson
*Attorney, Agent, or Firm*—Marthe L. Gibbons

[57] ABSTRACT

Slurry hydroconversion processes utilizing an aqueous solution of phosphomolybdic acid as catalyst precursor, which is subsequently converted to a solid molybdenum-containing catalyst, are improved when the catalyst precursor aqueous solution comprises a specified concentration of molybdenum derived from the phosphomolybdic acid. The improved hydroconversion processes and the improved method of preparing the catalyst are provided.

10 Claims, 1 Drawing Figure

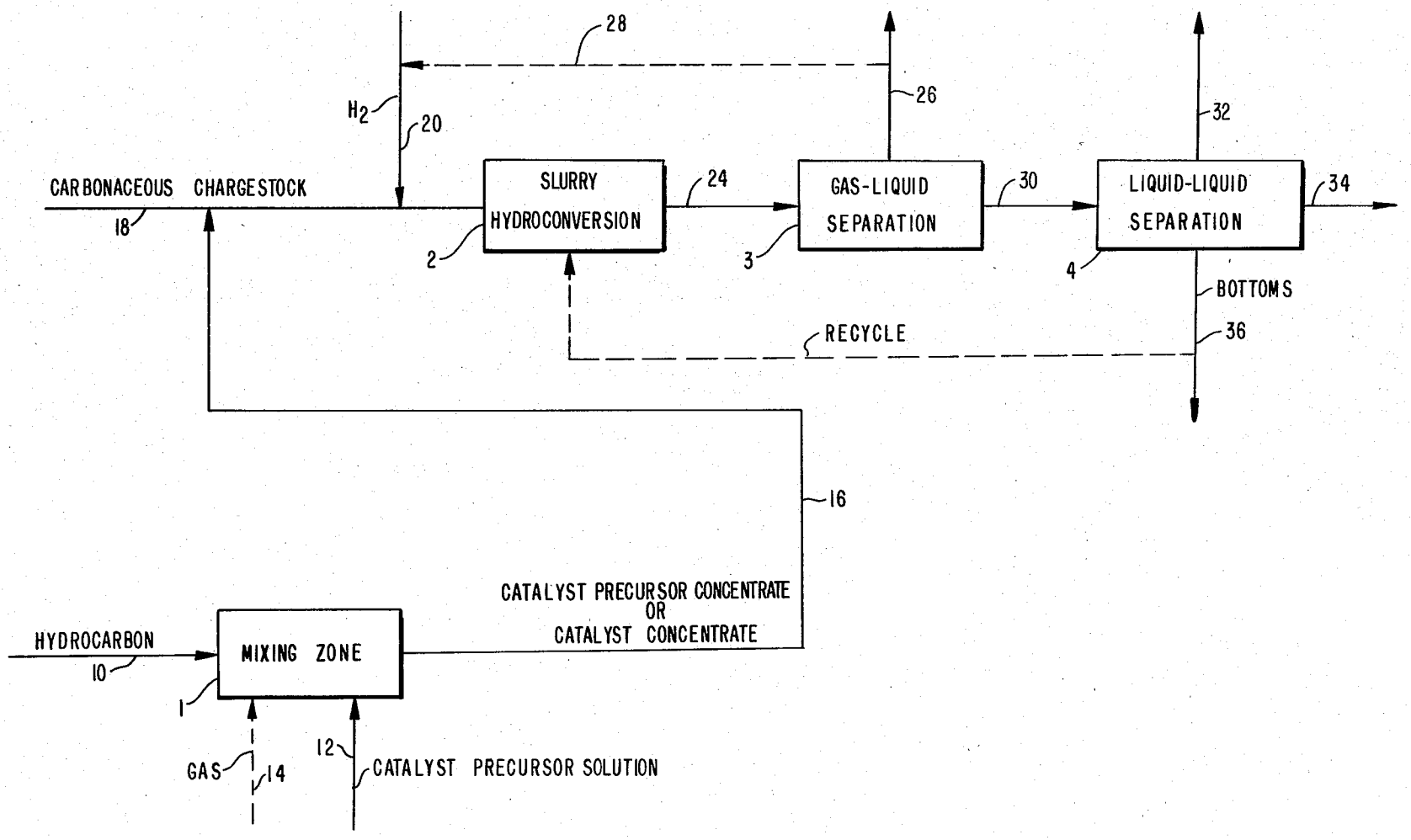
LIQUID-LIQUID SEPARATION
BOTTOMS
GAS-LIQUID SEPARATION
RECYCLE
SLURRY HYDROCONVERSION
CATALYST PRECURSOR CONCENTRATE OR CATALYST CONCENTRATE
CATALYST PRECURSOR SOLUTION
MIXING ZONE
GAS
HYDROCARBON
CARBONACEOUS CHARGESTOCK
$H_2$
34
32
36
4
30
26
3
16
24
28
2
20
12
14
1
10
18

HYDROCRACKING WITH AQUEOUS PHOSPHOMOLYBDIC ACID

CROSS REFERENCE TO RELATED APPLICATIONS

This application is a continuation-in-part of U.S. patent application Ser. No. 728,281, filed Apr. 29, 1985, the teachings of which are hereby incorporated by reference.

BACKGROUND OF THE INVENTION

1. Field of the Invention

This invention relates to an improvement in a slurry hydroconversion process utilizing a metal-containing catalyst prepared from a catalyst precursor dispersed in a hydrocarbon and to an improved method of preparing the catalyst.

2. Description of Information Disclosures

Slurry hydroconversion processes utilizing a catalyst prepared in a hydrocarbon oil from a thermally decomposable or oil soluble metal compound precursors are known. See, for example, U.S. Pat. Nos. 4,226,742; 4,244,839 and 4,111,787.

It is also known to use such catalyst in hydroconversion processes (i.e., coal liquefaction) in which coal particles are slurried in a hydrocarbonaceous material. See, for example, U.S. Pat. No. 4,077,867.

The term "hydroconversion" with reference to a hydrocarbonaceous oil is used herein to designate a catalytic process conducted in the presence of hydrogen in which at least a portion of the heavy constituents of the oil is converted to lower boiling hydrocarbon products while it may simultaneously reduce the concentration of nitrogenous compounds, sulfur compounds and metallic constituents of the oil.

The term "hydroconversion" with reference to coal is used herein to designate a catalytic conversion of coal to normally liquid hydrocarbons in the presence of hydrogen.

All boiling points referred to herein are atmospheric pressure equivalent boiling points unless otherwise specified.

It has now been found that when the solution of phosphomolybdic acid in water used as catalyst precursor comprises a specified concentration of molybdenum derived from the phosphomolybdic acid, the hydroconversion process produces less undesired coke and more normally liquid and gaseous products.

SUMMARY OF THE INVENTION

In accordance with the invention, there is provided, in a method for preparing a catalyst wherein aqueous phosphomolybdic acid is heated in the presence of a hydrocarbonaceous oil and a gas selected from the group consisting of hydrogen-containing gas, a hydrogen sulfide-containing gas and mixtures thereof to convert said phosphomolybdic acid to a solid catalyst, the improvement which comprises: (a) forming a mixture of a first hydrocarbonaceous material comprising constituents boiling above about 1050° F. and said aqueous solution of phosphomolybdic acid in an amount to provide from about 0.2 to 2 wt.% molybdenum, calculated as elemental metal, based on said hydrocarbonaceous material, said aqueous solution comprising from about 3 to about 5 weight percent molybdenum derived from said phosphomolybdic acid to produce a catalyst precursor concentrate; (b) introducing at least a portion of said catalyst precursor concentrate into a second hydrocarbonaceous material; (c) heating the mixture resulting from step (a) or the mixture resulting from step (b) in the presence of a gas selected from the group consisting of hydrogen, hydrogen sulfide and mixtures thereof, at conditions to convert said phosphomolybdic acid to a solid molybdenum-containing catalyst. In accordance with the invention, there is also provided a hydroconversion process utilizing the above prepared catalyst.

The term "phosphomolybdic acid" is used herein to designate aqueous solutions of the reaction product of $MoO_3$ with dilute phosphoric acid in which the phosphorus to molybdenum atomic ratio ranges from 0.083 to 2.00, preferably from 0.083 to 1.00 and most preferably from 0.083 to 0.25. Said solutions can contain one or more phosphomolybdic acid species such as the 12-molybdophosphoric acid and the dimeric 18-molybdophosphoric acid. Moreover, the crystalline 12 and 18 acids can be used to prepare the water solutions of phosphomolybdic acid used in the process of the invention. As to phosphomolybdic acids refer to *Topics In Current Chemistry No.* 76, published by Springer-Verlag of New York, pp. 1–64, 1978.

BRIEF DESCRIPTION OF THE DRAWING

The FIGURE is a schematic flow plan of one embodiment of the invention.

DESCRIPTION OF THE PREFERRED EMBODIMENT

Referring to FIG. 1, a heavy hydrocarbonaceous oil is introduced by line 10 into mixing zone 1. Suitable heavy hydrocarbonaceous oils for introduction into mixing zone 1, which may also serve as catalyst preparation zone, include hydrocarbonaceous oils comprising constituents boiling above 1050° F., preferably having at least 10 wt.% constituents boiling above 1050° F., such as crude oils, atmospheric residuum boiling above 650° F., vacuum residua boiling above 1050° F. Preferably, the hydrocarbonaceous oil has an initial boiling point above at least 650° F. and comprises asphaltenes. Instead of using one zone such as mixing zone 1 as both mixing and catalyst preparation zone, a separate zone or vessel could be used after mixing zone 1 to prepare the catalyst (i.e., convert the catalyst precursor to the solid catalyst). The hydrocarbonaceous oil carried by line 10 may be derived from any source such as petroleum, tar sand oil, shale oil, liquids derived from coal liquefaction processes and mixtures thereof. Generally, these oils have a Conradson carbon content ranging from about 5 to about 50 wt.% (as to Conradson carbon, see ASTM test D-189-65). An aqueous solution of phosphomolybdic acid (catalyst precursor) is introduced into mixing zone 1 by line 12. In accordance with the invention, the aqueous solution must comprise from about 3 to about 5 weight percent molybdenum (calculated as elemental metal) derived from a phosphomolybdic acid. A sufficient amount of the aqueous phosphomolybdic acid solution is introduced into mixing zone 1 to provide from about 0.2 to 2, preferably from about 0.2 to 1, more preferably 0.3 to 1 wt.% molybdenum from the phosphomolybdic acid, calculated as elemental metal based on the hydrocarbonaceous oil. The resulting mixture will herein be designated "catalyst precursor concentrate". Preferably, any water that may still be present in the catalyst precursor concentrate (i.e., water that has not yet evaporated) is removed from the catalyst precursor concentrate by heating the catalyst precursor concentrate to a temperature sufficient to evaporate (flash off) the water. If desired, the phosphomolybdic acid (catalyst precursor) may be converted to a solid catalyst in mixing zone 1 by introducing a gas selected from the group consisting of hydrogen-containing gas, a hydrogen sulfide-containing gas and mixtures thereof by line 14 into mixing zone 1 and heating the catalyst precursor concentrate to a temperature ranging from about 500° to 779° F., preferably to a temperature ranging from about 650° to 779° F., more preferably from about 680° to 730° F., and a total pressure ranging from 50 to 5000 psig, preferably from about 100 to about 2000 psig. Preferably the gas comprises hydrogen and from about 1 to 90 mole percent hydrogen sulfide based on the total gas. It is not necessary to convert the phosphomolybdic acid to a solid catalyst at this stage. If the catalyst precursor concentrate is not heated in the presence of a gas at conditions to convert the phosphomolybdic acid to the solid molybdenum containing catalyst, then the effluent of the mixing zone removed by line 16 will be the catalyst precursor concentrate. Preferably, water is removed from the catalyst precursor concentrate in zone 1 by heating the catalyst precursor concentrate at a temperature sufficient to evaporate the water or the catalyst precursor concentrate, after being removed from zone 1, may be passed to a drying zone (not shown) to evaporate water from the catalyst precursor concentrate. The molybdenum-containing concentrate, which may be a catalyst concentrate or a catalyst precursor concentrate, is removed by line 16 and introduced into line 18 which carries a carbonaceous chargestock comprising a hydrocarbon which may have the same boiling point range as the hydrocarbonaceous oil of line 10 or the hydrocarbon may be a single hydrocarbon (e.g., tetralin) or a mixture of hydrocarbons having the same boiling point range as the hydrocarbonaceous oil of line 10 or a different boiling point range as the hydrocarbonaceous oil of line 10. The carbonaceous chargestock may be a hydrocarbonaceous oil or coal in a hydrocarbon diluent. Suitable hydrocarbonaceous oil chargestocks include crude oils; mixtures of hydrocarbons boiling above 430° F., preferably above 650° F., for example, gas oils, vacuum residua, atmospheric residua, and once through coker bottoms. The hydrocarbonaceous oil chargestock may be derived from any source, such as petroleum, shale oil, tar sand oil, oils derived from coal liquefaction processes, including coal liquefaction bottoms, and mixtures thereof. Preferably, the hydrocarbonaceous oils have at least 10 wt.% materials boiling above 1050° F. More preferably, the hydrocarbonaceous oils have a Conradson carbon content ranging from about 5 to about 50 wt.%. Coal may be added to any of these oils. Alternatively, slurries of coal in a hydrocarbon diluent may be used as chargestock to convert the coal (i.e., coal liquefaction). The diluent may be a single type of hydrocarbon or a mixture of hydrocarbons and may be a light hydrocarbon or a heavy hydrocarbon, as described in U.S. Pat. No. 4,094,765, column 1, lines 54 to column 2, line 43, the teachings of which are hereby incorporated by reference. When the chargestock into which at least a portion of the catalyst precursor concentrate or catalyst concentrate of line 16 is introduced is an oil, the concentrate disperses in the oil. If the chargestock comprises coal in a diluent, the portion of concentrate of line 16 is added to the diluent before, after or simultaneously with the addition of coal to the diluent.

If the catalyst precursor concentrate has been added to the carbonaceous chargestock (instead of the catalyst concentrate), the phosphomolybdic acid may be converted to the solid molybdenum-containing catalyst at this stage by heating the resulting mixture of at least a portion of the carbonaceous chargestock and catalyst precursor in the presence of a gas selected from the group consisting of hydrogen-containing gas, hydrogen sulfide-containing gas or mixtures thereof at a temperature ranging from about 500° to about 779° F., preferably at a temperature ranging from about 650° to 779° F., more preferably at a temperature ranging from about 680° to 730° F. and a total pressure ranging from about 50 to about 5000 psig, preferably a pressure ranging from about 100 to 2000 psig. Alternatively, the chargestock comprising the catalyst precursor concentrate may be passed into the hydroconversion zone and the phosphomolybdic acid may be converted to the solid molybdenum-containing catalyst at hydroconversion conditions. A hydrogen-containing gas is introduced by line 20 into line 18. The mixture of carbonaceous chargestock, catalyst concentrate or catalyst precursor concentrate and hydrogen is passed into slurry hydroconversion zone 2. If the phosphomolybdic acid has not yet been converted to the solid catalyst, then the mixture of phosphomolybdic acid in the carbonaceous chargestock introduced into the hydroconversion zone 2 is converted to a solid catalyst at hydroconversion conditions. The catalyst precursor concentrate of line 16 is added to the carbonaceous chargestock in an amount sufficient to provide from about 10 to about 2000 wppm molybdenum, preferably 50 to 1000 wppm molybdenum, calculated as the elemental metal, based on the total hydroconversion zone chargestock, i.e., concentrate plus carbonaceous chargestock.

Suitable hydroconversion operating conditions are summarized in Table I.

TABLE I

| Conditions | Broad Range | Preferred Range |
|---|---|---|
| Temp., °F. | 800 to 900 | 820 to 870 |
| $H_2$ Partial Pressure, psig | 50 to 5000 | 100 to 2000 |

The hydroconversion zone effluent is removed by line 24 and passed to a gas-liquid separation zone 3 wherein the normally gaseous phase is separated from a normally liquid phase. The gaseous phase is removed from separation zone 3 by line 26. Alternatively, the gaseous phase, which comprises hydrogen, may be recycled by line 28, preferably after removal of undesired constituents to slurry hydroconversion zone 2 via line 20. The normally liquid phase, which comprises the molybdenum-containing catalytic solids and a hydroconverted hydrocarbonaceous oil product is passed by line 30 to separation zone 4 for fractionation by conventional means, such as distillation into various fractions such as light, medium boiling and heavy bottoms fractions. The light fraction is removed by line 32. The medium boiling fraction is removed by line 34. The heavy bottoms fraction is removed by line 36, and, if desired, at least a portion of the bottoms fraction may be recycled to hydroconversion zone 2.

Furthermore, if desired, the catalytic solids may be separated from the hydroconverted oil product and the separated solids may be recycled to hydroconversion zone 2. The following examples are presented to illustrate the invention.

EXAMPLE 1

PREPARATION OF CATALYST PRECURSOR CONCENTRATE WITH AQUEOUS PHOSPHOMOLYBDIC ACID SOLUTION CONTAINING 3 WT.% Mo

An aqueous solution containing 3.0 wt.% molybdenum was prepared by dissolving 1.2 g of commercially supplied, crystalline phosphomolybdic acid ($H_3PMo_{12}O_{40}.xH_2O$), which contained 50 wt.% Mo, in 18.8 g of deionized water.

Next, 86.7 g of a heavy Arabian atmospheric residuum that had an initial boiling point of 650° F. and contained 50 wt.% material boiling above 975° F., 48 wt.% material boiling above 1050° F. and 11.9 wt.% Conradson carbon components, was charged to a 300 ml Autoclave Engineer's stirred autoclave, which was then flushed with nitrogen and heated from room temperature to 176° F. with stirring. At this point, 13.3 g of the phosphomolybdic acid solution was injected (about 5 seconds required) into the stirred residuum and stirring was continued at 176° F. under a nitrogen atmosphere for a period of 30 minutes.

The resultant catalyst precursor concentrate, which contained 0.4 wt.% Mo, was discharged and stored under nitrogen at room temperature. The catalyst precursor concentrate of Example 1 is a catalyst precursor concentrate in accordance with the present invention.

EXAMPLE 2

PREPARATION OF CATALYST PRECURSOR CONCENTRATE WITH AQUEOUS PHOSPHOMOLYBDIC ACID SOLUTION CONTAINING 4 WT.% Mo

A catalyst precursor concentrate was prepared according to the procedure of Example 1 except that the phosphomolybdic acid solution (4 wt.% Mo) was comprised of 1.6 g of the crystalline phosphomolybdic acid dissolved in 18.4 g of deionized water, and that 10.0 g of this solution was mixed with 90.0 g of atmospheric residuum to form the precursor concentrate (0.40 wt.% Mo). The catalyst precursor concentrate of Example 2 is a catalyst precursor concentrate in accordance with the present invention.

EXAMPLE 3

PREPARATION OF CATALYST PRECURSOR CONCENTRATE WITH AQUEOUS PHOSPHOMOLYBDIC ACID SOLUTION CONTAINING 4 WT.% Mo

A catalyst precursor concentrate was prepared according to the procedure of Example 1 except that a laboratory preparation of phosphomolybdic acid was substituted for the commercial phosphomolybdic acid.

The laboratory sample of phosphomolybdic acid was prepared by refluxing a slurry of 3 g of micronized $MoO_3$ powder with a solution of 0.23 g of phosphoric acid (85% $H_3PO_4$) in 46.77 g of deionized water for 40 minutes at which time all of the $MoO_3$ had reacted to form the water soluble phosphomolybdic acid.

A charge of 9.74 g of this phosphomolybdic acid solution (4 wt.% Mo) was mixed with 90.26 g of residuum to form a catalyst precursor concentrate that contained 0.39 wt.% Mo. The catalyst precursor concentrate of Example 3 is a catalyst precursor concentrate in accordance with the present invention.

EXAMPLE 4

PREPARATION OF CATALYST PRECURSOR CONCENTRATE WITH AQUEOUS PHOSPHOMOLYBDIC ACID SOLUTION CONTAINING 5 WT.% Mo

A catalyst precursor concentrate was prepared according to the procedure of Example 1 except that the phosphomolybdic acid solution (5 wt.% Mo) was comprised of 1.0 g of the phosphomolybdic acid dissolved in 9.0 g of deionized water, and that 8.0 g of this solution was mixed with 92 g of heavy Arabian atmospheric residuum to form the precursor concentrate (0.4 wt.% Mo). The catalyst precursor concentrate of Example 4 is a catalyst precursor concentrate in accordance with the present invention.

EXAMPLE 5

PREPARATION OF CATALYST PRECURSOR CONCENTRATE WITH AQUEOUS PHOSPHOMOLYBDIC ACID SOLUTION CONTAINING 5 WT.% Mo

A duplicate preparation of the catalyst precursor concentrate of Example 4 was carried out. The resultant catalyst precursor concentrate contained 0.4 wt.% Mo. The catalyst precursor of Example 5 is a catalyst precursor concentrate in accordance with the present invention.

EXAMPLE 6

PREPARATION OF CATALYST PRECURSOR CONCENTRATE WITH AQUEOUS PHOSPHOMOLYBDIC ACID SOLUTION CONTAINING 5 WT.% Mo

A catalyst precursor concentrate was prepared according to the procedure of Example 1 with the exception that a lab preparation of aqueous phosphomolybdic acid was substituted for the aqueous solution of commercial phosphomolybdic acid.

The laboratory sample of aqueous phosphomolybdic acid, which contained 5 wt.% Mo, was prepared by refluxing a slurry of 3.75 g of pure, micronized $MoO_3$ powder with 46.25 g of a solution that contained 0.3 g phosphoric acid (85% $H_3PO_4$) in 45.95 g of deionized water. A clear solution of phosphomolybdic acid was obtained after 45 minutes of reflux and the solution was then cooled to room temperature for subsequent use in forming the precursor concentrate.

The resultant catalyst precursor concentrate of aqueous phosphomolybdic acid dispersed in atmospheric residuum contained 0.40 wt.% Mo. The catalyst precursor concentrate of Example 6 is a catalyst precursor concentrate in accordance with the present invention.

EXAMPLE 7 (COMPARATIVE)

PREPARATION OF CATALYST PRECURSOR CONCENTRATE WITH AQUEOUS PHOSPHOMOLYBDIC ACID SOLUTION CONTAINING 6 WT.% Mo

A catalyst precursor concentrate was prepared according to the procedure of Example 1 except that the phosphomolybdic acid solution (6 wt.% Mo) was comprised of 1.2 g of phosphomolybdic acid dissolved in 8.8 g of deionized water and that 6.7 g of this solution was mixed with 93.3 g of atmospheric residuum to form the catalyst precursor concentrate (0.4 wt.% Mo). The catalyst precursor concentrate of Example 7 is not a catalyst precursor concentrate in accordance with the present invention.

EXAMPLE 8 (COMPARATIVE)

PREPARATION OF CATALYST PRECURSOR CONCENTRATE WITH AQUEOUS PHOSPHOMOLYBDIC ACID SOLUTION CONTAINING 8 WT.% Mo

A catalyst precursor concentrate was prepared according to the procedure of Example 1 except that the phosphomolybdic acid solution (8 wt.% Mo) was comprised of 3.2 g of phosphomolybdic acid dissolved in 16.8 g of deionized water, and that 5.7 g of this solution was mixed with 94.3 g of atmospheric residuum to form the catalyst precursor concentrate (0.4 wt.% Mo). The catalyst precursor concentrate of Example 8 is not a catalyst precursor concentrate in accordance with the present invention.

EXAMPLE 9 (COMPARATIVE)

PREPARATION OF CATALYST PRECURSOR CONCENTRATE WITH AQUEOUS PHOSPHOMOLYBDIC ACID SOLUTION CONTAINING 15 WT.% Mo

A catalyst precursor concentrate was prepared according to the procedure of Example 1 except that the phosphomolybdic acid solution (15% Mo) was comprised of 3.0 g of phosphomolybdic acid dissolved in 7.0 g of deionized water, and that 2.90 g of this solution was mixed with 97.3 g of heavy Arabian atmospheric residuum to form the catalyst precursor concentrate (0.4 wt.% Mo). The catalyst precursor concentrate of Example 9 is not a catalyst precursor concentrate in accordance with the present invention.

EXAMPLE 10

PREPARATION OF CATALYST PRECURSOR CONCENTRATE WITH AQUEOUS PHOSPHOMOLYBDIC ACID SOLUTION THAT CONTAINS 4 WT.% Mo, FOLLOWED BY REMOVAL OF WATER

A catalyst precursor concentrate was prepared according to the procedure given in Example 1 except that the 30-minute stirred contact following the injection of phosphomolybdic acid solution into the residuum at 176° F. was omitted. Instead, after injection, the autoclave was heated with stirring from 176° F. to 305° F. and was held at 305° F. for 15 minutes with a flow of nitrogen through the autoclave to remove water.

The resultant, dewatered catalyst precursor concentrate contained 0.44 wt.% Mo. The catalyst precursor concentrate of Example 10 is a catalyst precursor concentrate in accordance with the present invention.

EXAMPLE 11

HYDROCONVERSION EXPERIMENTS COMPARING PRECURSOR CONCENTRATES

The relative effectiveness of the catalyst precursor concentrates of Examples 1–10 was determined in laboratory hydroconversion experiments that were carried out in the following manner.

A 300 ml Autoclave Engineer's stirred autoclave was charged at room temperature with 7.5 g of catalyst precursor concentrate, an amount that furnished 250 wppm Mo on the total charge of hydrocarbonaceous feed material. This charge comprised the precursor concentrate, 109.5 g of heavy Arabian vacuum residuum that contained 88.6 wt.% of material boiling above 975° F. and 21.1 wt.% of Conradson carbon components, and 3.0 g of heavy Arabian atmospheric residuum that contained 50.0 wt.% of material boiling above 975° F. and 11.9 wt.% Conradson carbon components.

After charging the catalyst precursor concentrate and residuum feeds, the autoclave was flushed with nitrogen, sealed, and heated with stirring from room temperature to 158° F. for a 15-minute stirred contact.

The autoclave was cooled to room temperature, flushed with hydrogen, charged with 50 psia $H_2S$ and 1365 psia $H_2$, and then heated with stirring from room temperature up to 725° F. for a stirred contact period of 20 minutes.

Upon completion of the 20-minute contact, a flow of $H_2$ was started through the autoclave and the autoclave was heated to the hydroconversion reaction temperature of 830° F. where it was held with stirring for a period of 180 minutes. Autoclave pressure during this reaction period was held at 2100 psig and the gas flow (measured at the reactor outlet at room temperature and atmospheric pressure) was 0.36 liter/minute.

The autoclave was then cooled, gaseous products were removed and collected for analysis of composition by mass spectrometry. Liquid and solid products remaining in the autoclave were removed by washing with toluene and the toluene wash was then filtered to recover insoluble solids. These solids were subsequently washed free of adhering oil with additional toluene and vacuum oven dried.

The yield of coke for the hydroconversion reaction was determined by burning a weighed sample of the toluene insoluble solids to obtain the weight fraction of carbon and the yield of coke was calculated as shown in Equation (1).

As can be seen from Table II, the hydroconversion experiments utilizing the catalyst precursor concentrates of the present invention, that is, the catalyst precursor concentrates of Examples 1, 2, 3, 4, 5, 6, and 10 produced less coke than the experiments utilizing the catalyst precursor concentrates that were not in accordance with the present invention, that is, the catalyst precursor concentrates of Examples 7, 8, and 9. The minimum coke yield occurred at a molybdenum concentration of about 5 weight percent (catalyst precursor concentrates of Examples 4, 5, and 6).

TABLE II

| | HYDROCONVERSION TEST RESULTS | | | | | | |
|---|---|---|---|---|---|---|---|
| Experiment No. | R-1820 | R-1461, R-1419 | R-1451, R-1463, R-1470 | R-1815 | R-1814 | R-1376[b] | R-1421[c] |
| Catalyst Precursor Concentrate of Example: | 1 | 2,3 | 4,5,6 | 7 | 8 | 9 | 10 |

TABLE II-continued

| HYDROCONVERSION TEST RESULTS | | | | | | | |
|---|---|---|---|---|---|---|---|
| Experiment No. | R-1820 | R-1461, R-1419 | R-1451, R-1463, R-1470 | R-1815 | R-1814 | R-1376[b] | R-1421[c] |
| Wt. % Mo in PMA[a] solution | 3.0 | 4.0 | 5.0 | 6.0 | 7.0 | 15.0 | 4.0 |
| Dewatered | no | no | no | no | no | no | yes |
| Coke Yield from Hydroconversion Test, Wt. % on Feed | 1.64 | 1.58[d] | 1.27[e] | 2.91 | 3.33 | 8.17 | 1.64 |

[a]PMA = Phosphomolybdic Acid.
[b]Run terminated after 1 hr. due to loss of catalyst activity.
[c]Reactor charge consisted of 6.9 g of catalyst precursor (0.44 wt. % Mo), 3.6 g of heavy Arab atmospheric resid and 109.5 g of heavy Arab vacuum resid.
[d]Average of two runs with coke yields of 1.63 and 1.52 wt. %.
[e]Average of three runs with coke yields of 1.35, 1.08 and 1.38 wt. %.
Equation (1)

$$\text{Coke Yield, \%} = \frac{\text{g. toluene insoluble solids} \times \text{wt. fraction carbon}}{\text{g. vacuum residuum} \times 0.85^{*}} \times 100$$

*This is an empirical factor for converting grams carbon to grams coke.

What is claimed is:

1. In a method for preparing a catalyst wherein aqueous phosphomolybdic acid is heated in the presence of a hydrocarbonaceous material and a gas selected from the group consisting of a hydrogen-containing gas, a hydrogen sulfide-containing gas and mixtures thereof to convert said phosphomolybdic acid to a solid catalyst, the improvement which comprises:

(a) forming a mixture of a first hydrocarbonaceous material comprising at least about 10 weight percent constituents boiling above about 1050° F. and said aqueous solution of phosphomolybdic acid in an amount to provide in said mixture from about 0.2 to 2 weight percent molybdenum, calculated as elemental metal, based on said first hydrocarbonaceous material, said aqueous solution comprising from about 3 to about 5 weight percent molybdenum derived from said phosphomolybdic acid to produce a catalyst precursor concentrate;

(b) introducing at least a portion of said catalyst precursor concentrate into a second hydrocarbonaceous material having a different boiling point range from said first hydrocarbonaceous material;

(c) heating the mixture resulting from step (a) or the mixture resulting from step (b) in the presence of a gas selected from the group consisting of hydrogen-containing gas, hydrogen sulfide-containing gas, and mixtures thereof at conditions to convert said phosphomolybdic acid to a solid molybdenum-containing catalyst.

2. The method of claim 1 wherein prior to step (b), water is removed from said mixture of step (a).

3. The method of claim 1 wherein said second hydrocarbonaceous material has a boiling point above about 430° F.

4. The method of claim 1 wherein in step (a), said molybdenum is present in said mixture in an amount ranging from about 0.2 to 1 weight percent.

5. The method of claim 1 wherein said first hydrocarbonaceous material is an atmospheric residuum.

6. The method of claim 1 wherein said heating of step (c) is conducted prior to step (b) at a temperature ranging from about 500° to 779° F.

7. The method of claim 1 wherein said gas of step (b) comprises hydrogen and from about 1 to about 90 mole percent hydrogen sulfide.

8. The method of claim 1 wherein said first hydrocarbonaceous material is an atmospheric residuum and wherein said second hydrocarbonaceous material comprises a vacuum residuum.

9. The method of claim 1 wherein said molybdenum in step (a) is present in an amount ranging from about 0.3 to 1 weight percent molybdenum, calculated as elemental metal, based on said first hydrocarbonaceous material.

10. The method of claim 1 wherein said second hydrocarbonaceous material is a hydrocarbonaceous oil.

* * * * *